US011518178B2

(12) United States Patent
Sang et al.

(10) Patent No.: US 11,518,178 B2
(45) Date of Patent: Dec. 6, 2022

(54) ROTARY PRINTING INTEGRATED INK BOX FOR SEAL PRINTING

(71) Applicant: HAIMING UNITED ENERGY GROUP MATRIXNETS TECHNOLOGY CO, LTD., Hebei (CN)

(72) Inventors: Haiming Sang, Hebei (CN); Ge Gan, Hebei (CN); Song Li, Hebei (CN)

(73) Assignee: Haiming United Energy Group Matrixnets Tech Co Ltd, Tangshan (CN)

( * ) Notice: Subject to any disclaimer, the term of this patent is extended or adjusted under 35 U.S.C. 154(b) by 85 days.

(21) Appl. No.: 17/271,274

(22) PCT Filed: Aug. 11, 2020

(86) PCT No.: PCT/CN2020/108313
§ 371 (c)(1),
(2) Date: Mar. 25, 2021

(87) PCT Pub. No.: WO2021/052059
PCT Pub. Date: Mar. 25, 2021

(65) Prior Publication Data

US 2021/0379904 A1 Dec. 9, 2021

(30) Foreign Application Priority Data

Sep. 19, 2019 (CN) ..... 201910887604.5

(51) Int. Cl.
*B41J 2/175* (2006.01)

(52) U.S. Cl.
CPC ..... *B41J 2/17556* (2013.01); *B41J 2/17513* (2013.01); *B41J 2/17553* (2013.01)

(58) Field of Classification Search
CPC ..... B41J 2/17556; B41J 2/17513; B41J 2/17553; B41J 2/1753; B41J 2/175; B41J 2/17503
(Continued)

(56) References Cited

U.S. PATENT DOCUMENTS 5,451,995 A * 9/1995 Swanson ..... B41J 2/17513 220/611
10,688,793 B1 * 6/2020 Anderson, Jr. ..... B05B 17/0684
(Continued)

FOREIGN PATENT DOCUMENTS

CN 202764437 3/2013
CN 207697297 8/2018
(Continued)

OTHER PUBLICATIONS

International Search Report dated Nov. 4, 2020.

*Primary Examiner* — Kristal Feggins
*Assistant Examiner* — Alexander D Shenderov
(74) *Attorney, Agent, or Firm* — Gerald E. Hespos; Michael J. Porco

(57) ABSTRACT

A rotary printing integrated ink box special for seal printing comprises an ink box body (1) with a cylindrical or elliptic cylindrical outer contour, a spray head (6) with a circuit board (5) is arranged outside the ink box body (1), the spray head (6) corresponds to an ink outlet (3), and contacts (7) connected with control lines of the spray head (6) are integrated on the circuit board (5); and a rotary fixed surface of the ink box body (1) is parallel to a rotary injection surface of the spray head (6).

10 Claims, 4 Drawing Sheets

(58) Field of Classification Search
USPC ..... 347/86
See application file for complete search history.

(56) References Cited

U.S. PATENT DOCUMENTS

| | | | | |
|---|---|---|---|---|
| 2001/0009432 | A1* | 7/2001 | Olsen | B41J 2/17509 347/86 |
| 2003/0070568 | A1 | 4/2003 | Toyama | |

FOREIGN PATENT DOCUMENTS

| | | |
|---|---|---|
| CN | 207972423 | 10/2018 |
| CN | 109732901 | 5/2019 |
| CN | 209208278 | 8/2019 |
| CN | 110254048 | 9/2019 |
| CN | 110481161 | 11/2019 |
| CN | 110525053 | 12/2019 |
| CN | 210940967 | 7/2020 |
| CN | 210940968 | 7/2020 |
| JP | 2003-54098 | 2/2003 |

* cited by examiner

ROTARY PRINTING INTEGRATED INK BOX FOR SEAL PRINTING

TECHNICAL FIELD

Field of the Invention

The present disclosure relates to the field of ink boxes, in particular to a rotary printing integrated ink box that is particularly well suited for seal printing.

Background

An integrated ink box has a spray head integrated on the ink box. When ink is used up, a new ink box is replaced, and, accordingly, a new printing spray head is replaced at the same time. By using the ink box, high printing precision can be achieved, the printing quality can be guaranteed, and due to the fact that the spray head is replaced along with the ink box, the printing quality cannot be reduced due to abrasion of the spray head.

However, an existing ink box structure is limited to parallel printing when used for traditional printing. The parallel printing mode generally needs to be completed by multiple strokes back and forth, and is time-consuming, energy-consuming and low in efficiency. Moreover, an irregular structure of the existing ink box can influence the volume of a whole printer, so that the whole printer is large and clumsy. In addition, the structural design of a traditional printer is such that the outer edge of a circle printed by a traditional parallel printer is not round enough. More particularly, a printing spray head of the traditional printer transversely walks on the surface of paper to generate a visible error, namely a stepped circular graph, at the joint of the stroke and the next stroke.

When a user needs to print patterns such as a round seal, an elliptic seal, a square seal and a rectangular seal, it is extremely inconvenient to use any one of the above devices. Therefore, a special small portable printing ink box for the field of seal printing or seal stamping is urgently needed to solve the problems that an existing printer is large in size and clumsy and seal pattern printing cannot be completed properly.

SUMMARY

The present disclosure aims to provide a rotary printing integrated ink box special for seal printing, and solves the problem of low printing efficiency caused by the fact that an existing ink box is not suitable for rotary printing.

In order to solve the technical problem, a technical solution adopted by the present disclosure is as follows:

A rotary printing integrated ink box special for seal printing comprises an ink box body with a cylindrical or elliptic cylindrical outer contour. The ink box body is of a hollow structure, and an air pressure balance assembly is arranged inside the ink box body. An ink outlet is formed in one end face of the ink box body, and a vent hole is formed in the peripheral side wall of the ink box body. The axial position of the air pressure balance assembly in the ink box body is located between the ink outlet and the vent hole. A spray head with a circuit board is arranged outside the ink box body. The spray head corresponds to the ink outlet, and contacts connected with control lines of the spray head are integrated on the circuit board.

In some embodiments, the ink box body comprises an ink box main body with two open ends, and an ink box upper cover and an ink box lower cover that are connected detachably to the two ends of the ink box main body. The ink outlet of this embodiment is formed in the ink box lower cover.

In certain embodiments, slots are formed in the two ends of the ink box main body respectively. Additionally, the ink box upper cover is provided with upper cover plugs matched with the slots, and the ink box lower cover is provided with lower cover plugs matched with the slots.

A filtering part with which the ink outlet is covered may be arranged inside the ink box body, and filtering holes may be distributed uniformly in the filtering part.

Further, the filtering part may be adhered to the peripheral side of the ink outlet.

In some embodiments, the air pressure balance assembly comprises a sponge body, clamping parts arranged on the front side and the rear side of the sponge body, and a first elastic part and a second elastic part which wrap the two sides of the sponge body. The two ends of the first elastic part and the second elastic part are connected with each other to form a spindle and are clamped in the ink box body.

Clamping holes may be formed in the two ends of the first elastic part, and clamping edges matched with the clamping holes may be arranged at the two ends of the second elastic part.

In certain embodiments, the circuit board is clamped or pasted and adhered to the ink box body through screws.

The ink outlet and the spray head may extend from the edge of one end of the ink box body to the center. Additionally, the effective lengths of the ink outlet and the spray head are equal to the vertical distance from the edge of the section of the ink box body to the center or twice of the vertical distance.

Compared with the prior art, the present disclosure has the following beneficial effects:

The ink box body is substantially in a regular shape. Thus, the whole printing equipment can be matched with the ink box to be designed in the regular shape. This substantially rectangular design of the ink box enables the whole printing equipment to be more miniaturized and portable. The two end faces of the ink box body are parallel. The ink outlet is located in one of the end faces, and the spray head is installed at the ink outlet. Thus, the ink box can be used for parallel printing and rotary printing. Additionally, the effective lengths of the ink outlet and the spray head are equal to the vertical distance from the edge of the cross section of the ink box body to the center or twice of the vertical distance. Furthermore, the ink box only needs to rotate by 180 degrees or 360 degrees to complete graphic printing, so that the printing speed and efficiency are improved.

BRIEF DESCRIPTION OF THE DRAWINGS

The present disclosure is further described below in combination with the accompanying drawings.

Figure 1:
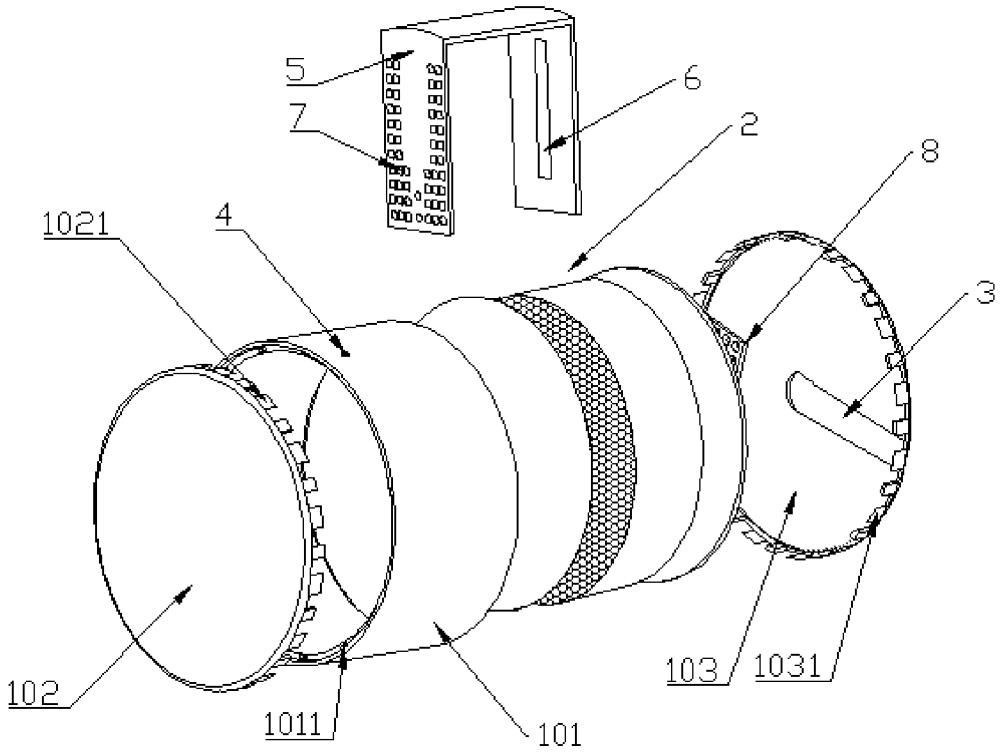
FIG. 1 is an explosive view of one visual angle (excluding a first elastic part and a second elastic part) in a first embodiment of the present disclosure.
Figure 2:
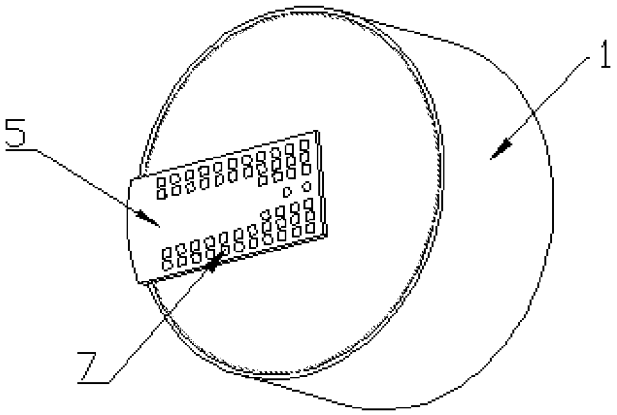
FIG. 2 is a structure diagram of one visual angle in the first embodiment of the present disclosure.
Figure 3:
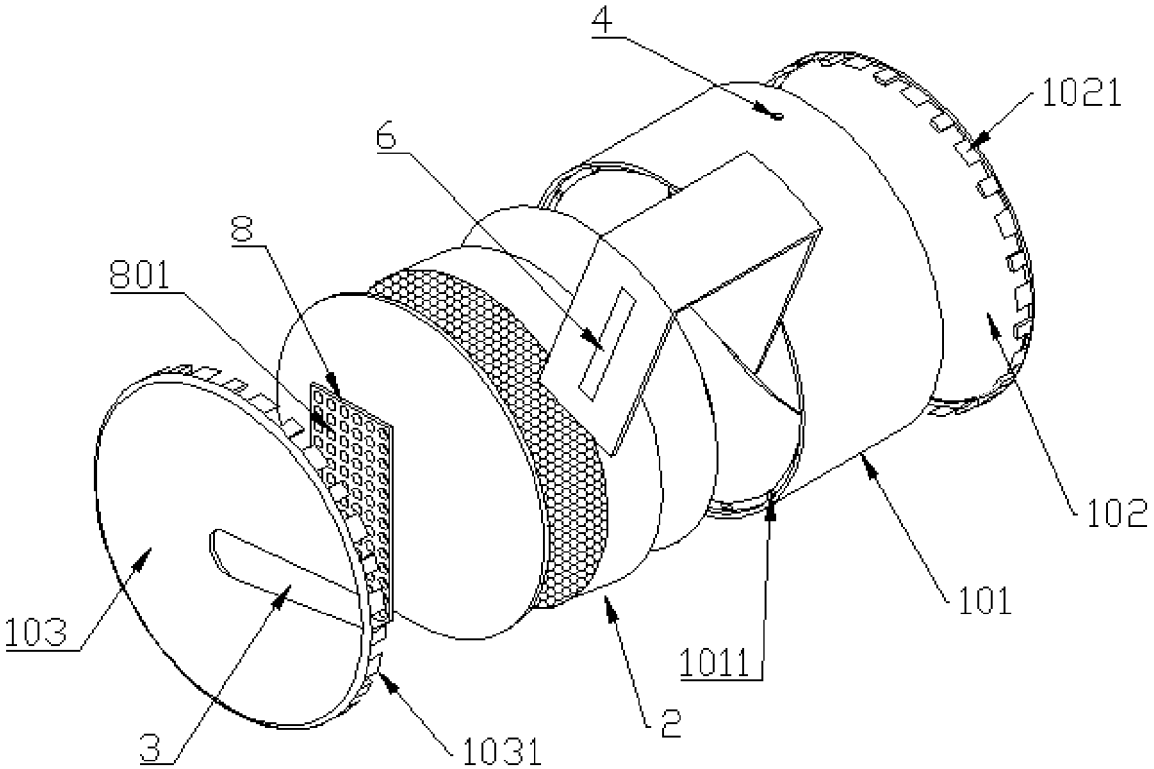
FIG. 3 is an explosive view of another visual angle (excluding the first elastic part and the second elastic part) in the first embodiment of the present disclosure.
Figure 4:
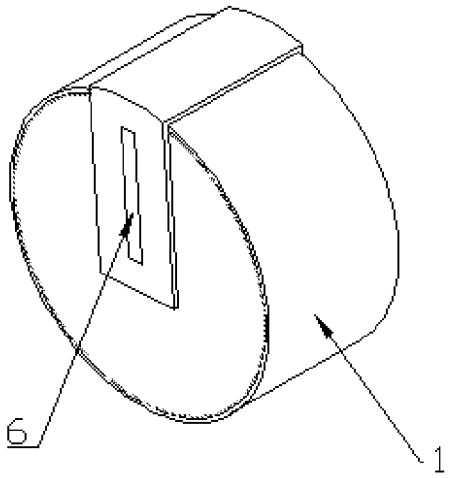
FIG. 4 is a structure diagram of another visual angle in the first embodiment of the present disclosure.
Figure 5:
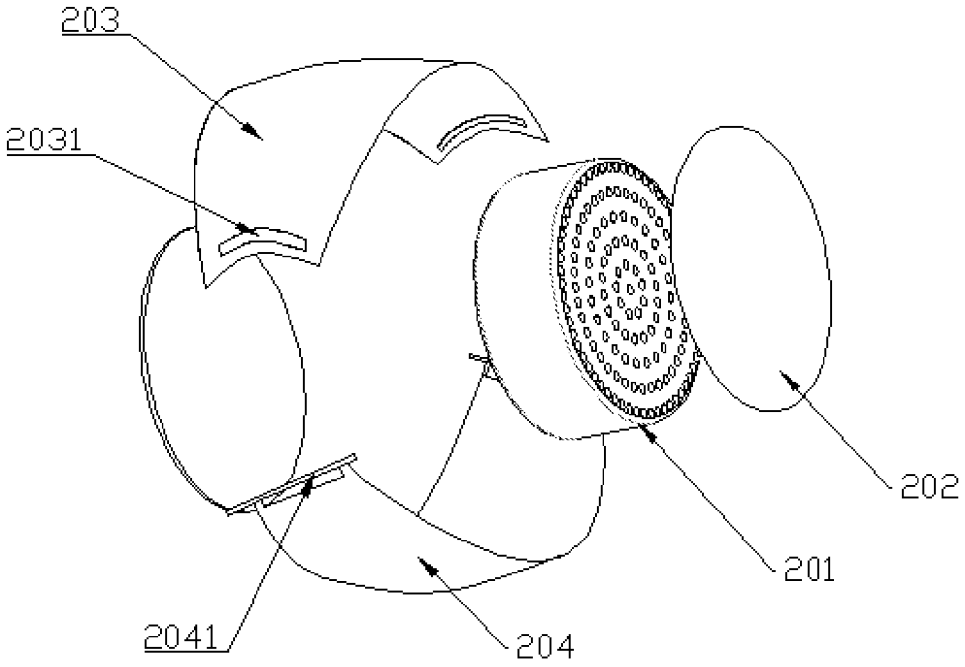
FIG. 5 is a structure diagram of an air pressure balance assembly in the present disclosure.
Figure 6:
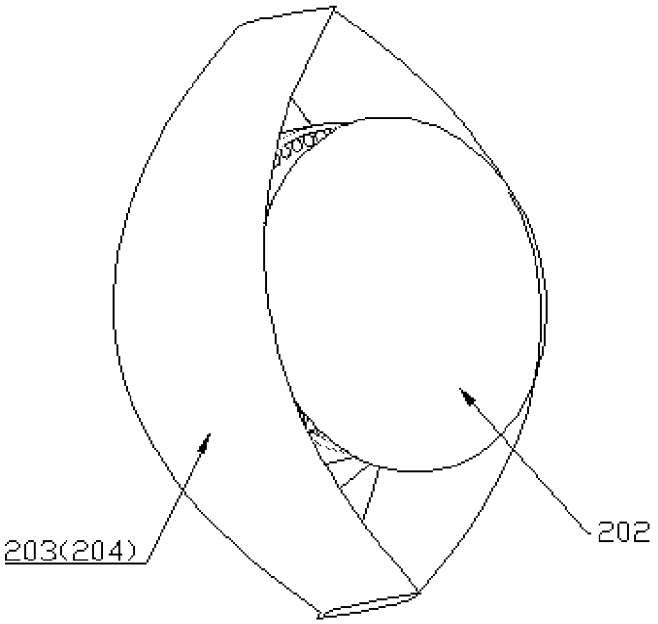
FIG. 6 is an assembling structure diagram of the air pressure balance assembly in the present disclosure.

Reference signs: 1, ink box body; 101, ink box main body; 1011, slot; 102, ink box upper cover; 1021, upper cover plug; 103, ink box lower cover; 1031, lower cover plug; 2, air pressure balance assembly; 201, sponge body; 202, clamping part; 203, first elastic part; 2031, clamping hole; 204, second elastic part; 2041, clamping edge; 3, ink outlet; 4, vent hole; 5, circuit board; 6, spray head; 7, contact; 8, filtering part; and 801, filtering hole.

DETAILED DESCRIPTION

As shown in FIG. 1 to FIG. 6, in a first embodiment, a rotary printing integrated ink box special for seal printing comprises an ink box body 1 with a cylindrical outer contour. Specifically, the ink box body 1 consists of a cylindrical ink box main body 101 with two open ends, a circular ink box upper cover 102 and an ink box lower cover 103. Slots 1011 are formed in the two ends of the ink box main body 101. The slots are distributed uniformly along the end face of the ink box main body to define a circular array. Upper cover plugs 1021 matched with the slots 1011 in one side of the ink box main body 101 are arranged on the ink box upper cover 102, and lower cover plugs 1031 matched with the slots 1011 in the other side of the ink box main body 101 are arranged on the ink box lower cover 103. When the ink box is used, the upper cover plugs of the ink box upper cover are inserted into the slots in one side of the ink box main body, and the lower cover plugs of the ink box lower cover are inserted into the slots in the other side of the ink box main body, so that a hollow ink box body is formed. An air pressure balance assembly 2 is arranged in the ink box body 1, and the air pressure balance assembly 2 can be buckled on the inner wall of the ink box main body 101. Specifically, the air pressure balance assembly 2 comprises a sponge body 201, clamping parts 202 arranged on the front side and the rear side of the sponge body 201, and a first elastic part 203 and a second elastic part 204 which wrap the two sides of the sponge body. Clamping holes 2031 are formed in the two ends of the first elastic part 203, and clamping edges 2041 are formed at the two ends of the second elastic part 204. The clamping edges can be clamped in the ends of the first elastic part and the second elastic part, and the two ends of the first elastic part 203 and the second elastic part 204 are connected with each other to form a spindle and clamped in the ink box body 1. When ink becomes less and less, the first elastic part and the second elastic part do not deform and shrink, and a supporting effect is achieved. An ink outlet 3 is formed in the ink box lower cover 103, so that ink in the ink box body 1 is ejected from the ink outlet. A vent hole 4 is formed in the peripheral side wall of the ink box body 1. More particularly, the vent hole is formed in the side wall of the ink box main body 101 and is used for introducing high-pressure gas into the ink box body 1. The axial position of the air pressure balance assembly 2 in the ink box body 1 is located between the ink outlet 3 and the vent hole 4, so that high-pressure gas introduced into the vent hole is blocked by the air pressure balance assembly 2 from the ink outlet. The air pressure balance assembly 2 is used for keeping air pressure balance in the ink box body, and certain negative pressure is generated by ink in the ink box body, so that the ink can be prevented from rushing out at once, and the ink can be ensured to flow out uniformly and slowly.

A spray head 6 with a circuit board 5 is arranged outside the ink box body 1. The circuit board can be fixed on the ink box body 1 through screws, clamping or pasting. The spray head 6 corresponds to the ink outlet 3, and the ink sprayed from the ink outlet is sprayed in a specific form through the spray head. The circuit board further is provided with a plurality of contacts. The circuit board integrates control lines on the spray head together to finally form the contacts, and a drive board (unshown in the figure) controls the spray head to spray ink through the contacts.

In order to prevent impurities in ink from blocking the spray head, a filtering part 8 with which the ink outlet 3 is covered is arranged inside the ink box body 1, and specifically, the filtering part 8 is adhered to the peripheral side of the ink outlet 3. Filtering holes 801 are distributed uniformly in the filtering part 8, and the filtering holes 801 are used for preventing impurities from blocking spray holes in the spray head.

In the specific embodiment, the working lengths of the ink outlet 3 and the spray head 6 are the length of the radius of the circular ink box lower cover. The ink box body is driven by a rotating mechanism to rotate and work, and the spray head sprays patterns through the spray holes in the spray head. The spray head in this scheme only needs to rotate by one circle to complete printing of the needed patterns. Compared with a traditional parallel printing mode, the printing stroke is obviously shortened, and the printing efficiency is improved. In addition, compared with a traditional ink box, the ink box suitable for rotary printing is more regular in shape. Therefore, the volume of the whole printing equipment can be reduced when the ink box is assembled in the whole printing equipment, and the equipment is more miniaturized and portable.

Figure 7:
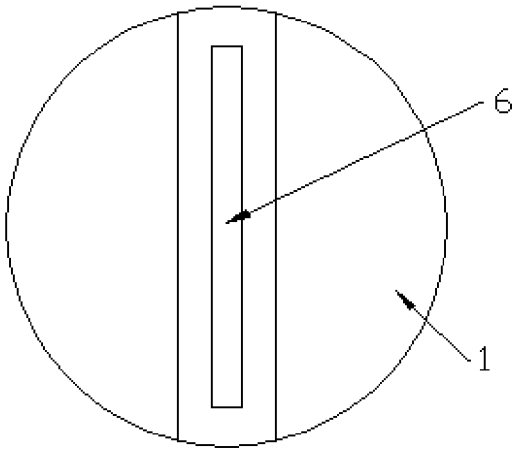
FIG. 7 is a structure diagram in a second embodiment of the present disclosure.

FIG. 7 shows a second embodiment of the rotary printing integrated ink box special for seal printing. Characteristics that are the same as those described above are not described herein again. The rotary printing integrated ink box of FIG. 7 is characterized in that the working lengths of the ink outlet 3 and the spray head 6 are the diameter length of the circular ink box lower cover; or the working lengths of the ink outlet 3 and the spray head 6 are equal to the diameter length on the elliptic cylindrical ink box lower cover at the corresponding position. According to this embodiment, the spray head only needs to rotate by half a circle or more than half a circle to print a required pattern.

Certainly, the ink box body with the circular or elliptic cylindrical cross section can be matched with the ink outlet and the spray head with the diameter length or the radius length, and details are not described herein again.

The embodiments described above only describe the preferred manner of the present disclosure and do not limit the scope of the present disclosure, and various modifications and improvements made to the technical solution of the present disclosure by those skilled in the art will fall within the scope of protection as determined by the claims of the present disclosure without departing from the spirit of the design of the present disclosure.

What is claimed is:

1. A rotary printing integrated ink box for seal printing, wherein the rotary printing integrated ink box comprises:

an ink box body (1) with a cylindrical or elliptic cylindrical outer contour, the ink box body (1) is a hollow structure with a peripheral side wall and opposite end faces;

an ink outlet (3) formed in one of the end faces of the ink box body (1);

a vent hole (4) formed in the peripheral side wall of the ink box body (1);

an air pressure balance assembly (2) arranged inside the ink box body (1) at an axial position between the ink outlet (3) and the vent hole (4);

a spray head (6) with a circuit board (5) arranged outside the ink box body (1), the spray head (6) corresponds to the ink outlet (3), and contacts (7) connected with control lines of the spray head (6) are integrated on the circuit board (5); and the ink outlet (3) and the spray head (6) extend from a circumferential edge of one end of the ink box body (1) to a center thereof, and effective lengths of the ink outlet (3) and the spray head (6) are equal to a radial distance from the edge of the section of the ink box body (1) to the center or twice the radial distance.

2. The rotary printing integrated ink box for seal printing according to claim 1, wherein the ink box body (1) comprises an ink box main body (101) with open upper and lower ends, and an ink box upper cover (102) and an ink box lower cover (103) that are connected detachably to the respective upper and lower ends of the ink box main body (101); and the ink outlet (3) is formed in the ink box lower cover (103).

3. The rotary printing integrated ink box for seal printing according to claim 2, wherein a plurality of slots (1011) are formed in the upper and lower ends of the ink box main body (101) respectively, the ink box upper cover (102) is provided with a plurality of upper cover plugs (1021) matched with the slots (1011) in the upper end of the ink box main body (101), and the ink box lower cover (103) is provided with a plurality of lower cover plugs (1031) matched with the slots (1011) in the lower end of the ink box main body (101).

4. The rotary printing integrated ink box for seal printing according to claim 1, further comprising a filtering part (8) arranged inside the ink box body (1) and covering the ink jet outlet (3), and filtering holes (801) are uniformly distributed in the filtering part (8).

5. The rotary printing integrated ink box for seal printing according to claim 4, wherein the filtering part (8) is adhered to areas of the ink box lower cover (103) adjacent a peripheral side of the ink outlet (3).

6. The rotary printing integrated ink box for seal printing according to claim 1, wherein the air pressure balance assembly (2) comprises a sponge body (201), clamping parts (202) arranged on a front side and a rear side of the sponge body (201), and a first elastic part (203) and a second elastic part (204) wrap opposite first and second circumferential sides of the sponge body (201), and opposite circumferential ends of the first elastic part (203) and the second elastic part (204) are connected with each other to form a spindle and clamped in the ink box body (1).

7. The rotary printing integrated ink box for seal printing according to claim 6, wherein clamping holes (2031) are formed in the opposite circumferential ends of the first elastic part (203), and clamping edges (2041) matched with the clamping holes (2031) are arranged at the opposite circumferential ends of the second elastic part (204).

8. The rotary printing integrated ink box for seal printing according to claim 1, wherein the circuit board (5) is clamped or pasted and adhered to the ink box body (1) through screws.

9. A rotary printing integrated ink box for seal printing, wherein the rotary printing integrated ink box comprises:

an ink box body (1) with a cylindrical or elliptic cylindrical outer contour, the ink box body (1) is a hollow structure with a peripheral side wall and opposite end faces;

an ink outlet (3) formed in one of the end faces of the ink box body (1);

a vent hole (4) formed in the peripheral side wall of the ink box body (1);

an air pressure balance assembly (2) arranged inside the ink box body (1) at an axial position between the ink outlet (3) and the vent hole (4);

a spray head (6) with a circuit board (5) arranged outside the ink box body (1), the spray head (6) corresponds to the ink outlet (3), and contacts (7) connected with control lines of the spray head (6) are integrated on the circuit board (5), wherein the air pressure balance assembly (2) comprises a sponge body (201), clamping parts (202) arranged on a front side and a rear side of the sponge body (201), and a first elastic part (203) and a second elastic part (204) wrap opposite first and second circumferential sides of the sponge body (201), and opposite circumferential ends of the first elastic part (203) and the second elastic part (204) are connected with each other to form a spindle and clamped in the ink box body (1).

10. The rotary printing integrated ink box for seal printing according to claim 9, wherein clamping holes (2031) are formed in the opposite circumferential ends of the first elastic part (203), and clamping edges (2041) matched with the clamping holes (2031) are arranged at the opposite circumferential ends of the second elastic part (204).

* * * * *